United States Patent [19]

Spilker, Jr. et al.

[11] 4,326,292

[45] Apr. 20, 1982

[54] RANDOM ENERGY COMMUNICATION SYSTEM

[75] Inventors: James J. Spilker, Jr., Palo Alto; William R. Ramsay, Mountain View, both of Calif.

[73] Assignee: Lockheed Missiles & Space Company, Inc., Sunnyvale, Calif.

[21] Appl. No.: 16,097

[22] Filed: Mar. 18, 1960

[51] Int. Cl.[3] ..... H04K 1/00

[52] U.S. Cl. ..... 455/27; 455/29

[58] Field of Search ..... 332/68; 250/6.6, 6.4; 325/33, 56; 455/26, 27, 29, 59, 101; 375/2.1, 58

[56] References Cited

U.S. PATENT DOCUMENTS

| | | | |
|---|---|---|---|
| 1,811,102 | 6/1931 | Adams et al. | 455/27 |
| 2,091,271 | 8/1937 | Conklin . | |
| 2,418,119 | 4/1947 | Hansen . | |
| 2,530,140 | 11/1950 | Atkinson | 375/2.1 |
| 2,530,824 | 11/1950 | King | 455/27 |
| 2,580,148 | 12/1951 | Wirkler | 329/145 |
| 2,624,836 | 1/1953 | Dicke | 332/68 |
| 2,645,677 | 7/1953 | Young, Jr. | 375/2.1 |
| 2,972,046 | 2/1961 | Seaton | 332/68 |
| 3,071,649 | 1/1963 | Goodall | 375/2.1 |

*Primary Examiner*—Howard A. Birmiel
*Attorney, Agent, or Firm*—John J. Morrissey

EXEMPLARY CLAIM

5. An intelligence communication system comprising a transmitter and a receiver; said transmitter comprising means for obtaining a relatively wide band random energy carrier signal, means for modulating said random carrier signal with an intelligence signal thereby forming a message signal, means responsive to said wide band energy obtaining means for deriving a reference signal which differs in frequency with said message signal by a definite fixed amount and means for radiating to the receiverr both the message and reference random signals; said receiver comprising an antenna for picking up both the message and reference random signal simultaneously, means for operating on at least one of said message and reference random signals to obtain message and reference random signals which are recombined and mixer means for multiplying the recombined message and reference random signals to obtain a resultant signal from which the intelligence signal can be derived.

5 Claims, 6 Drawing Figures

RANDOM ENERGY COMMUNICATION SYSTEM

This invention relates generally to means and methods of transmitting and receiving intelligence. More particularly, the invention relates to improved means and methods of transmitting and receiving intelligence using random energy as the carrier signal.

In present day communications and intelligence transmitting and receiving systems, the intelligence which is to be transmitted is caused to modulate some type of narrow band periodic carrier, such as a sine wave, and this periodic carrier is then transmitted to the receiver where the intelligence signal is extracted therefrom by suitable detection means. Various types of modulation are employed for modulating the periodic carrier, such as amplitude modulation, frequency modulation, phase modulation, etc. In recent years, attention has been directed mainly towards new types of modulation and methods and means of transmitting the greatest intelligence in the smallest bandwidth so as to permit a more efficient use of the ever-overcrowding frequency spectrum.

In accordance with the present invention, a new and unexplored approach is taken to the overall problem of intelligence communication. We have discovered that by employing relaively wide band random energy as the carrier signal in place of the relatively narrow band periodic carrier signals employed in present day communication systems, it is possible to achieve important advantages and features not available to these presently known systems employing periodic carriers. One of the important advantages of this new approach is that it permits the use of large energies at frequencies which heretofore were unavailable for intelligence communication because the energy could not practically be converted to the periodic form required in present day systems. Many other important advantages of the invention will become apparent from the description provided herein.

We are aware that unpredictable or haphazard variations have been introduced into various communication systems for the purpose of obtaining secrecy. All of these systems, however, basically operate by modifying a conventional type of transmitting and receiving system so that there will be some haphazard feature about the transmitted signal which will make it unintelligible to an unwanted listener. Because these secrecy communications systems operate by introducing this haphazard variation into a conventional type of transmitted signal, they involve increased complexities which are necessary in order to produce the haphazard variation in the transmitted signal, and to decode the signal at the receiver. For this reason no one has seriously attempted to employ the haphazard techniques of such secrecy communication systems where secrecy was not one of the important features. It is important to note that such prior art secrecy communication systems do not employ a true random carrier signal, but rather, the transmitted signal is given a random form by introducing some haphazard variation, such as by modulating the carrier with a random signal or by adding to the carrier a noise signal which produces a resultant signal in which the actual periodic carrier is masked.

Accordingly, it is the broad object of the present invention to provide transmitting and receiving systems for intelligence communication in which random energy is employed as the signal carrier.

Another object of this invention is to provide a transmitting and receiving system for intelligence communication employing a random energy carrier signal, which overcomes the problem of selective fading caused by multipath propagation.

Still another object of this invention is to provide a transmitting and receiving system for intelligence communication which permits efficient exploitation of a large portion of the electromagnetic spectrum, including those portions in the ultra-microwave range.

Yet another object of the present invention is to provide a transmitting and receiving system for intelligence communication which operates independently of the medium through which the signal passes or the relative velocity between the transmitter and receiver.

A further object of the invention is to provide a transmitting and receiving system for intelligence communication which has a high immunity to jamming and which can not be easily interpreted by an unwanted listener.

A still further object of the present invention is to provide a transmitting and receiving system for intelligence communication which can be used in the same band as is used for conventional communication with negligible interference from or to the conventional signals.

Another object of this invention is to provide a transmitting and receiving system for intelligence transmission which permits multiple information channel occupancy of the same spectral region by signals which are not separable in either the time or frequency domain.

Still another object of this invention is to provide a transmitting and receiving system for intelligence communication which permits more efficient use of the total bandwidth of a given portion of the frequency spectrum than is presently obtainable with conventional systems.

An additional object of the present invention is to provide the systems of the aforementioned objects by means of circuitry and devices which are relatively simple and non-critical.

In accordance with the present invention the above objects are attained by means of transmitting and receiving systems in which random energy is employed as the signal carrier. The specific nature of the invention, as well as other objects, uses and advantages thereof, will clearly appear from the following description and from the accompanying drawing in which.

Like numerals designate like elements through the figures of the drawing.

Figure 1:
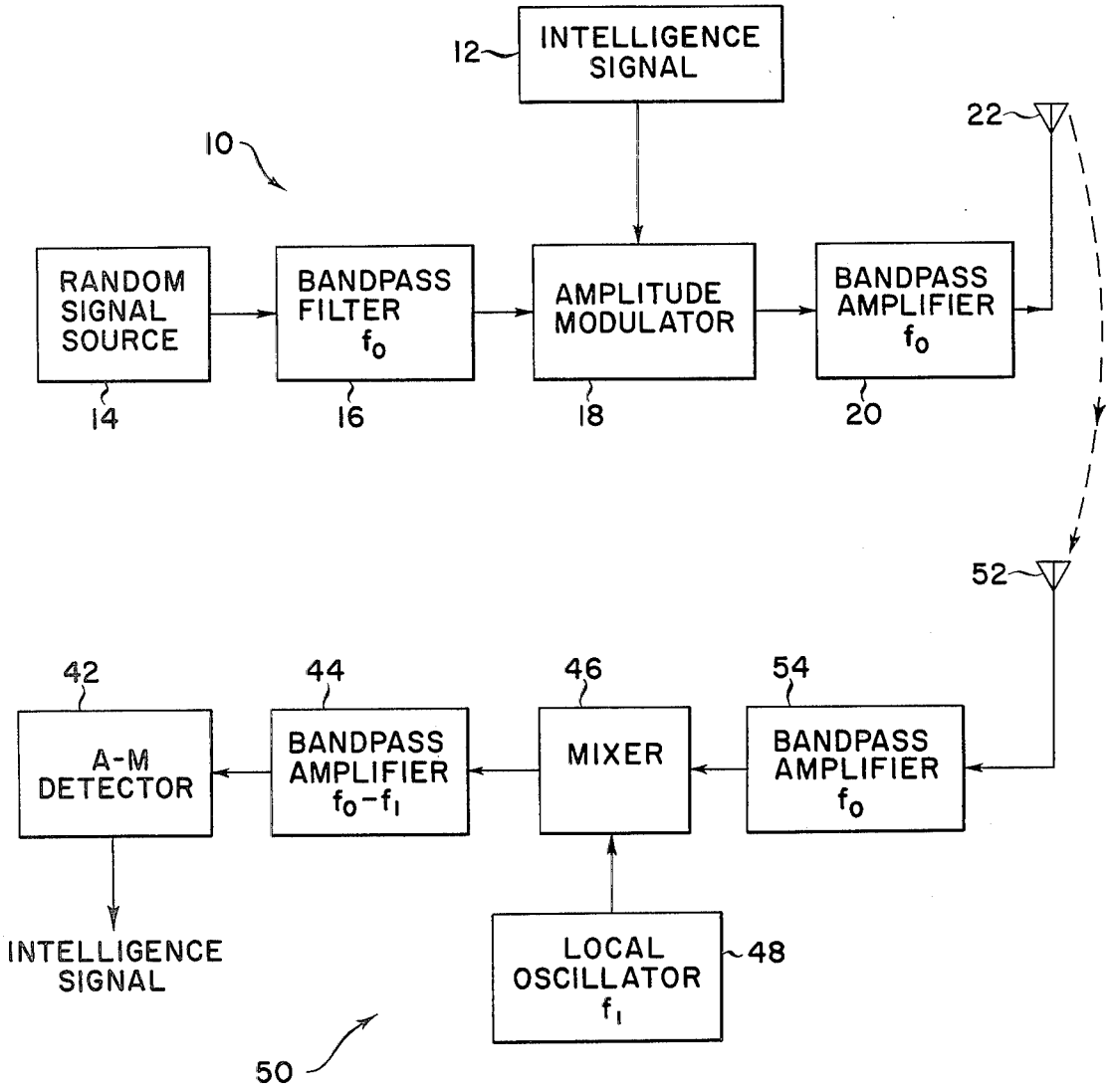
FIG. 1 is a block diagram of a basic embodiment of a transmitting and receiving system in which random energy is employed as the signal carrier, in accordance with the invention.

As mentioned previously the use of random energy as a carrier signal in intelligence communication systems offers significant advantages and features not available to conventional systems which employ a periodic carrier. The capability of using random energy as the carrier signal is by itself a very important feature, since it permits the use of various forms of energy which are widely present in nature in abundance without the need for generating a high energy periodic carrier. This is particularly valuable at ultra-high microwave frequencies where the generation of periodic carriers of sufficient power for transmission has proved to be a severe problem. By means of the present invention, therefore, this portion of the spectrum is more readily available for intelligence communication purposes. There are also many other important advantages to be derived from the use of random energy as the signal carrier and these will be brought out in connection with the description of the various figures of the drawing.

FIG. 1 shows a block diagram of a basic form of transmitting and receiving system for intelligence communication which employs random energy as the carrier signal. Besides permitting the use of random energy, this sytem provides an additional feature of some importance, namely the capability of eliminating the problem of selective fading caused by multipath propagation effects, which sometimes severely hampers conventional systems.

In FIG. 1 a transmitter 10 and a receiver 50 are shown. In the transmitter 10, a random signal source 14 which may be derived either from energy occurring naturally or from random energy generated in a conventional manner, such as by using amplified thermal, shot or any other available noise source, provides a random signal over a wide band of frequencies. The random output signal of the random signal source 14 is fed to a bandpass filter 16 having a center frequency at $f_0$. The bandpass filter 16 restricts the random signal to a relatively wide band and then feeds it to an amplitude modulator 18 where it is amplitude modulated by an intelligence signal 12. The bandwidth provided by the bandpass filter 16 is chosen at least ten times as large as the bandwidth of the intelligence signal 12 and such a bandwidth is ordinarily very much larger than that of conventional narrow band periodic communication systems. The designation of the random carrier bandwidth as relatively large in the specification and claims is intended to refer to a bandwidth chosen in this manner.

The amplitude modulated signal is then amplified by an amplifier 20 having a center frequency also at $f_0$ and a bandwidth sufficient to pass the random signal band and the important frequency sideband components generated by modulation. The amplified amplitude modulated random signal from the amplifier 20 is then radiated to the receiver 50 by the antenna 22.

The receiver 50 has an antenna 52 which picks up the transmitted radiation from the transmitter 10 and feeds it to a bandpass amplifier 54 having a center frequency at $f_0$ and a bandwidth sufficient to pass the random signal band and its important amplitude modulation components. The output of the bandpass amplifier 54 is fed to a mixer 46 where it is heterodyned with the signal from a local oscillator 48 of frequency $f_1$, producing an output from the mixer 46 centered at the frequency $f_0$-$f_1$. The purpose of the mixer 46 and the local oscillator 48 is to translate the center frequency of the amplitude modulated random signal to a suitable frequency for detection, and is not essential. The output of the mixer 46 is then fed to a bandpass amplifier 44 having its center frequency at $f_0$-$f_1$, and a bandwidth sufficient to pass the random signal band and its modulation components. The amplified modulated random signal then passes to a conventional type of A-M detector 42 which detects the envelope thereof to produce a signal corresponding to the intelligence signal 12.

The problem of selective fading caused by multipath propagation is now eliminated in the system of FIG. 1 by making the bandwidth of the bandpass filter 16 (which determines the bandwidth of the random carrier) sufficiently large so that the received signals which have traveled over different paths (and thus are delayed with respect to one another) are substantially independent. For example, if the maximum delay between important received components is of the order of T seconds, then the bandwidth $B_c$ of the bandpass filter 16 should be greater than $4\pi/T$.

It should be noted in the system of FIG. 1 that the signal transmitted is spread over a relatively large band. Because of this, the energy in any small bandwidth, such as might be the bandwidth of an ordinary periodic receiver, will be quite small so that the operation of a system such as shown in FIG. 1 will do no more than slightly increase the noise level of any such conventional system.

Figure 2:
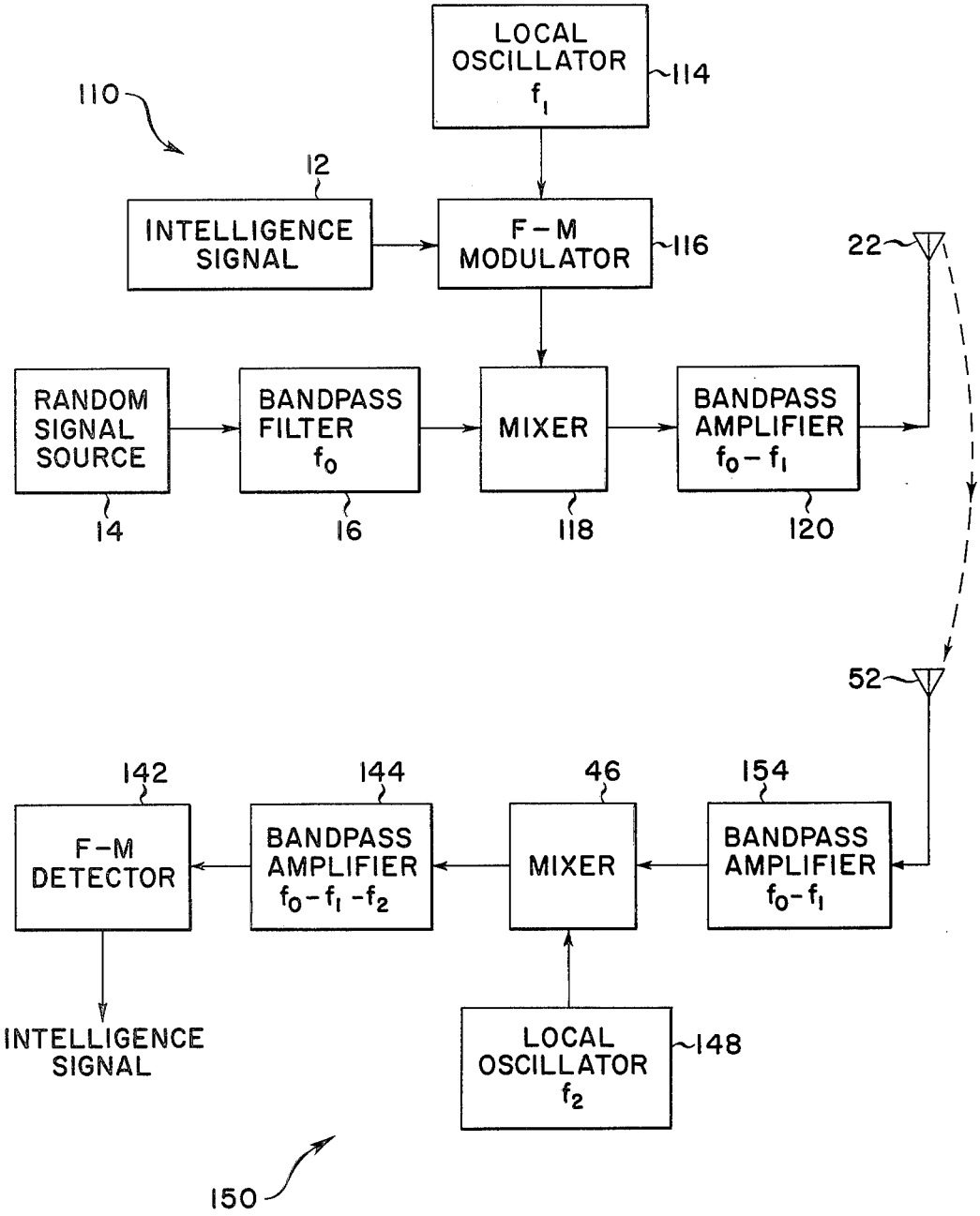
FIG. 2 is a block diagram of a modified embodiment of the system of FIG. 1.

In FIG. 2 a modified version of FIG. 1 is presented in which the random carrier signal is frequency modulated instead of being amplitude modulated. To accomplish this, the output of the bandpass filter 16 is fed to a mixer 118 where it is heterodyned with a sinusoidal signal which has been frequency modulated by the intelligence signal 12. This frequency modulated sinusoidal signal is produced by passing the output from a local oscillator 114 to an F-M modulator 116 where it is frequency modulated by the intelligence signal 12, the output of the F-M modulator 116 being fed to the mixer 118.

The output from the mixer 118 is then fed to a bandpass amplifier 120 having a center frequency at $f_0$-$f_1$ and a bandwidth sufficient to pass only one random signal sideband of the heterodyned output from the mixer 118. It will be understood, therefore, that the output from the bandpass amplifier 120 will be the random signal in a band whose center frequency varies in accordance with the intelligence signal 12, the sinusoidal local oscillator signal and the other random signal sideband being substantially eliminated by the bandpass amplifier 120. It should be noted that this is different from prior art secrecy systems where noise is introduced into the output signal in some manner so as to mask out the periodic signal carrying the message, in which case the periodic signal is still present in recoverable form in the output.

The transmitted random signal from the transmitter 110 is picked up by the antenna 52 of the receiver 150 and is fed to a bandpass amplifier 154 whose center frequency is now $f_0$-$f_1$, the bandwidth of the bandpass amplifier 154 being sufficient to receive the random signal band and the important modulation components generated by the intelligence signal 12. As in FIG. 1, the output of the bandpass amplifier 154 passes to a mixer 46 where it is heterdyned with the signal from a local oscillator 148 having a frequency $f_2$ to produce an output from the mixer 46 which is translated to a convenient frequency, this being $f_0$-$f_1$-$f_2$. A bandpass amplifier 144 centered at this frequency $f_0$-$f_1$-$f_2$ now amplifies the band modulated random signal and like the bandpass amplifier 154 has sufficient bandwidth to pass the random signal band and the modulation components generated by the intelligence signal 12. The amplified output from the bandpass amplifier 144 may then be fed to a conventional type of F-M detector 142 which produces the intelligence signal 12.

The system of FIG. 2 not only provides all the advantages of conventional frequency modulation, but additionally offers the advantage of permitting a random energy source to be used, and can be made to eliminate selective fading due to multipath propagation in the same manner as the system of FIG. 1. As with any frequency modulation system, the system of FIG. 2 is somewhat more complex than that of FIG. 1 and somewhat greater bandwidths are required for the bandpass amplifiers to pass the larger spectrum produced by this type of modulation. Like the system of FIG. 1, because the transmitted signal is spread over a relatively large band, it will not significantly interfere with or be affected by conventional narrow band channels within the band.

In systems such as described in connection with FIGS. 1 and 2, small signal suppression effects are encountered so that it is usually necessary to operate with detector signal-to-noise ratios greater than unity. This problem will be somewhat greater in the systems of FIGS. 1 and 2 than in conventional narrow channel periodic carrier systems, since the detection process will unavoidably generate noise frequencies at the same frequencies as the intelligence signal, but this is overcome by operating at a sufficient signal-to-noise ratio of at least greater than unity. Where it is difficult to generate large amounts of periodic carrier energy, or where selective fading is a serious problem, the need for a relatively large signal-to-noise ratio is only a minor disadvantage as compared to the great benefits to be obtained by using these systems.

In the systems of FIGS. 1 and 2 the random signal produced by the random signal source 14 may have a wide variety of amplitude or frequency distributions and the frequency spectrum in the band provided by the bandpass filter 16 need not be flat in order to obtain satisfactory operation of the system. However, the use of particular amplitude and/or frequency distributions and a particular shaped bandpass for the bandpass filter 16 may offer some advantages, especially in regard to signal-to-noise ratio in certain applications, and such modifications are to be considered within the scope of this invention.

Figure 3:
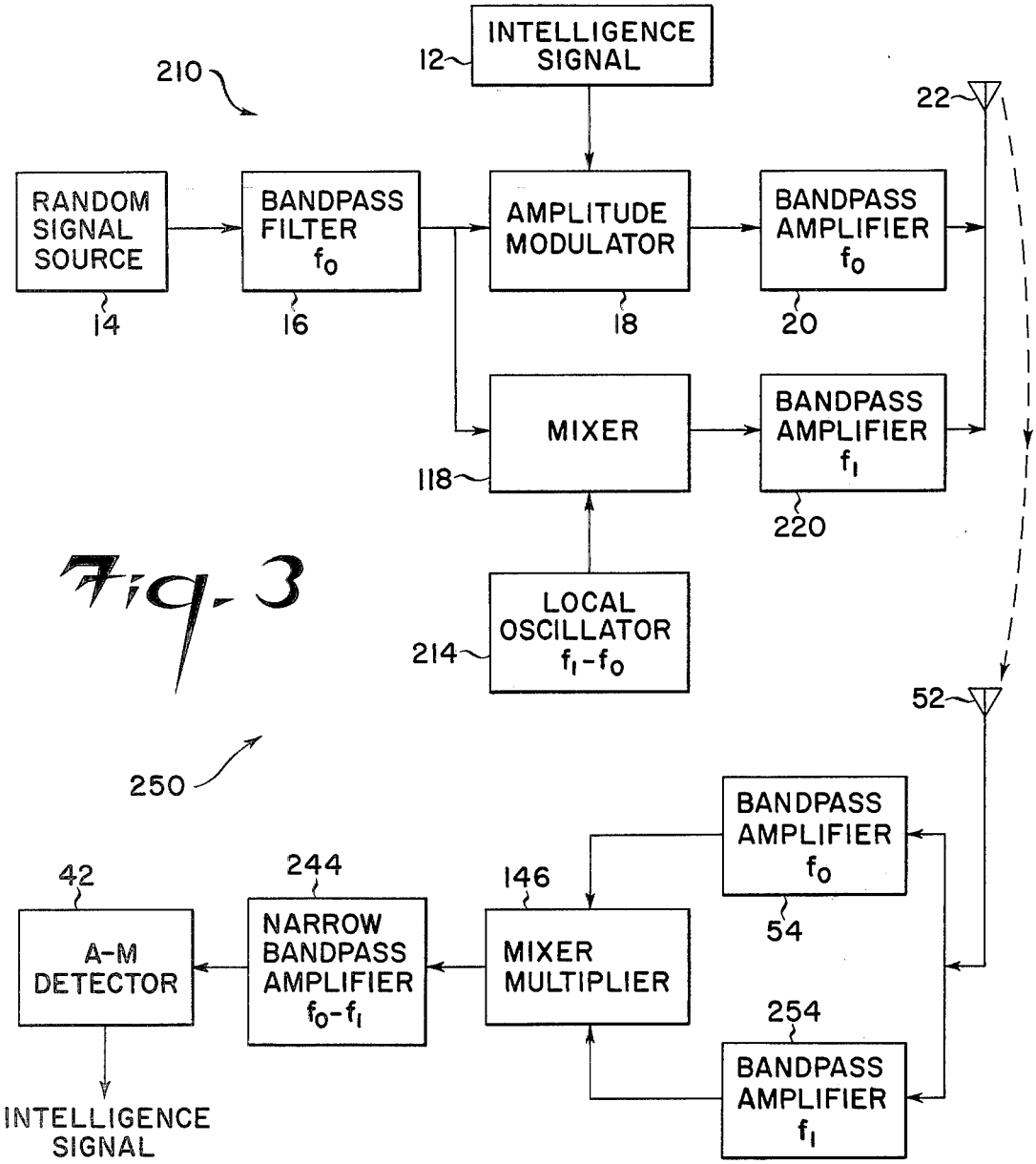
FIG. 3 is a block diagram of another embodiment of a transmitting and receiving system in which random energy is employed as the signal carrier, in accordance with the invention.

In order to take further advantage of the benefits to be derived from using a random energy carrier, a system such as shown in FIG. 3 has been devised which greatly improves the performance and versatility of a communication system employing a random energy carrier. The system of FIG. 3 not only incorporates the advantages of the systems of FIGS. 1 and 2, but it also provides other important advantages not obtainable in conventional periodic carrier systems. For example, a system such as illustrated in FIG. 3 permits the transmission and reception of signals between points independently of their relative velocity and without concern for doppler shift. Also, from a signal power point of view, the system of FIG. 3 is highly efficient and is able to operate on signal-to-noise ratios commensurate with that of conventional narrow band periodic carrier systems. Other advantages of the system of FIG. 3 and the related system of FIG. 4 will become evident from the following description thereof.

In the transmitter 210 of the system of FIG. 3, the random signal source 14 and the bandpass filter 16 may be the same as in the systems of FIGS. 1 and 2. As in FIGS. 1 and 2 the output of the bandpass filter 16 is a relatively wide band random signal centered at the frequency $f_0$ of the bandpass filter 16. This band of random energy is then amplitude modulated and amplified by means of the amplitude modulator 18 and the bandpass amplifier 20 as in FIG. 1, after which it is fed to the antenna 22 for radiation to the receiver 250.

In the system of FIG. 3 the random signal output of the bandpass filter 16 is also fed to a mixer 118 where it is heterodyned with a signal of frequency $f_1$-$f_0$ obtained from a local oscillator 214, the output from the mixer 118 thereby being the random signal in the band determined by the bandpass filter 16 and centered at the frequency $f_1$ rather than $f_0$. This random signal centered at the frequency $f_1$ is then amplified by a bandpass amplifier 220 also centered at the frequency $f_1$ and having a sufficient bandwidth to pass the band of the random signals. The output of the bandpass amplifier 220 is connected to the antenna 22 so that the unmodulated random signal centered at $f_1$ is radiated along with the amplitude modulated random signal centered at the frequency $f_0$. The frequencies $f_0$ and $f_1$ are chosen so that the bands of the random signals do not overlap. The amplitude modulated random signal centered at $f_0$ obtained from the bandpass amplifier 20 will hereinafter be referred to as the message random signal while the unmodulated random signal centered at $f_1$ obtained from the bandpass amplifier 220 will hereinafter be referred to as the reference random signal.

At the transmitter 210 the message random signal and the reference random signal are made uncorrelated to a preselected degree which degree is a function of the difference $f_1$-$f_0$.

Both the reference and message random signals are transmitted to the receiver 250 where they are picked up by the antenna 52 and fed to bandpass amplifiers 54 and 254 which separate the message and reference random signals from one another. The bandpass amplifier 54 is centered at the frequency $f_0$ and has a bandwidth sufficient to pass the message random signal and its modulation components, but is not so wide as to pass the reference random signal. Conversely, the amplifier 254 is centered at $f_1$ and has a bandwidth sufficient to pass the reference random signal, but not so wide as to pass the message random signal. Thus, the output from the bandpass amplifier 54 will contain only the message random signal and the output from the bandpass amplifier 254 will contain only the reference random signal. After being separated by the bandpass amplifiers 54 and 254, the message and reference random signals are fed to a mixer multiplier 146 which effectively multiplies these two signals together to provide a resultant mixer output signal which is an amplitude modulated sine wave of frequency $f_0$-$f_1$, amplitude modulated by the intelligence signal 12. Typical types of mixer multipliers which may be used as the mixer multiplier 146 in FIG. 3 are described in "Modulation Theory" by H. S. Block, pp. 145–148, and "Communication Theory" by W. Jackson, pp. 200–202.

The message and reference random signals are thus transformed by the mixer multiplier 146 into two amplitude modulated sine waves whose center frequencies are the sum and difference, $f_0+f_1$ and $f_0-f_1$, of the center frequencies of the message and reference random signals, and the amplitude modulation of each sine wave is the intelligence signal 12 itself. These amplitude modulated sine waves are then fed to a narrow bandpass amplifier 244 having a center frequency corresponding to the frequency of the amplitude modulated sine wave $f_1$-$f_0$ and a bandwidth sufficient only to pass this lower sideband and the important intelligence amplitude modulation components. The amplified signal from the narrow bandpass amplifier 244 is then fed to an ordinary A-M detector such as 42 where the original intelligence signal 12 is obtained.

The random signal provided by the source 14 need not have any particular amplitude or frequency characteristic and the bandpass filter 16 need provide no special frequency shaping, but such refinements are useful in some applications. In many applications it will be convenient to use for the random signal a noise signal having a constant energy per unit bandwidth and a bandpass filter 16 with a flat response so that at the output of the bandpass filter 16 a flat noise signal is obtained over the band.

In order to provide a clearer understanding of a system such as FIG. 3, typical frequencies and bandwidths will now be presented for a specific operating embodiment in which the system of FIG. 3 has been employed. It is to be understood, however, that the presentation of these specific frequencies and bandwidths is in no way intended to limit the scope of this invention.

The random signal obtained from the random signal source 14 which is fed to the bandpass filter 16 is conveniently chosen to be what is known as "white" noise which has a substantially uniform power density over a relatively wide frequency range. The bandpass filter 16 is chosen to have a center frequency $f_0$ at one megacycle and a bandwidth equal to 100 kilocycles. The bandpass amplifier 20 will then also be centered at 1 megacycle and is provided with a bandwidth of about 150 kilocycles. An intelligence signal 12 having frequencies ranging from a couple of cycles to the order of 1500 cycles is employed as the intelligence signal 12 to be transmitted. The local oscillator 214 which feeds the mixer 118 provides a sine wave having a frequency equal to 1.75 megacycles so that the bandpass amplifier 220 is centered at 2.75 megacycles with a bandwidth of 120 kilocycles.

From the transmitter 210, therefore, there will be radiated a message random signal centered at 1 megacycle having a bandwidth slightly greater than 100 kilocycles and a reference random signal centered at 2.75 megacycles having a bandwidth of 100 kilocycles. In the receiver 250 these message and reference random signals are picked up by the antenna 52 and applied to the bandpass amplifiers 54 and 254 for separation. The bandpass amplifier 54 is centered at 1 megacycle with a bandwidth of about 150 kilocycles to pass the message random signal, while the bandpass amplifier 254 is centered at 2.75 megacycles with a bandwidth of the order of 120 kilocycles to pass the reference random signal.

After the message and reference random signals are multiplied in the multiplier mixer 146, the output obtained therefrom is two amplitude modulated sine waves having frequencies equal to the sum and difference of the center frequencies of the message and reference random signals, namely 3.75 and 1.75 megacycles, respectively. The bandwidth of each amplitude modulated sine wave is determined by the amplitude modulation components of the intelligence signal, which is about 3,000 cycles. The narrow bandpass amplifier 244 is centered at the frequency 1.75 megacycles to pass the lower sideband and has a narrow bandpass of the order of 5,000 cycles. Upon feeding the output from the narrow bandpass amplifier 244 to a conventional type of A-M detector 42, the intelligence signal 12 is obtained.

In considering the operation of the system of FIG. 3, various features should be noted. First, if the bandwidth of the carrier is made sufficiently large so that the received signals which have traveled over different paths (and thus are delayed with respect to one another) are substantially independent as was described in connection with the systems of FIGS. 1 and 2, then the problem of selective fading caused by multipath propagation will be eliminated. Second, since the transmitted signal is spread over a relatively wide band of frequencies and demodulation is obtained by multiplying a reference random signal with the message random signal, it will be understood by those skilled in the art that the signals may be received with small signal-to-noise ratios and yet be demodulated with high signal-to-noise ratios.

A further feature of the system of FIG. 3 is that it is most difficult to jam because of the wide range of jamming frequencies which must be provided and the small possibility that they will be of the proper form to mask out the actual signal being received. For similar reasons, it also follows that the transmitted signals will be unintelligible to an unwanted listener who is using conventional receiving equipment. If greater secrecy is desired, the reference or message random signals may be delayed or passed through a distortion network in the transmitter in which case an unwanted listener would not be able to interpret the message without knowing the distortion employed. In the receiver the distortion is removed by passing the appropriate signal through an inverted distortion network.

Figure 3A:
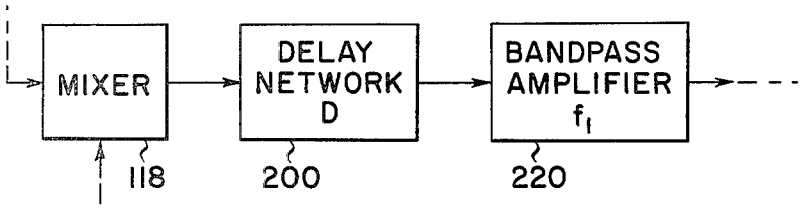
FIGS. 3A and 3B are block diagrams showing how the system of FIG. 3 can be modified.
Figure 3B:
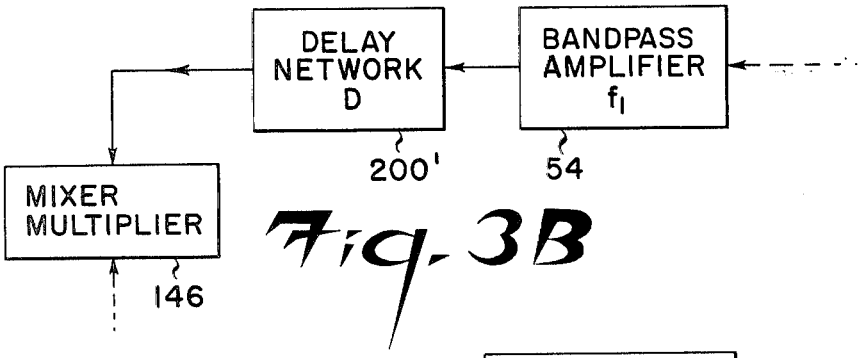

FIGS. 3A and 3B illustrate how greater secrecy can be provided in the system of FIG. 3 by the introduction of a delay-type distortion network. As shown in FIG. 3A, a delay network 200 providing a delay D is inserted between the bandpass amplifier 220 and the mixer 118 so as to introduce a delay D into the reference random signal at the transmitter 210. The resultant transmitted signal will then be unintelligible to a listener who does not know the amount of delay introduced.

The receiver 250 of FIG. 3 is now modified as shown in FIG. 3B by inserting a delay network 200' having the same delay D between the bandpass amplifier 54 and the mixer multiplier 146 so as to introduce a delay D into the message random signal at the receiver 250. Effectively, therefore, when the message and reference random signals are applied to the mixer multiplier 146, they will both have been delayed by the same amount D and operation in the mixer multiplier 146 will be as described in connection with the system of FIG. 3.

Still another important feature of a system such as illustrated in FIG. 3 is that its performance is substantially unaffected by the relative velocity between the transmitter 210 and the receiver 250, since both the message and reference random signals follow the same paths. In conventional periodic carrier systems a relative velocity between transmitter and receiver has a serious effect on transmission because of the doppler shift introduced.

Also, as was the case with the systems of FIGS. 1 and 2, the system of FIG. 3 will not significantly affect or be affected by conventional periodic carrier communication transmission. And still further, because demodulation is achieved by multiplying the message and reference random signals, the message signal can be recognized to a much greater extent, even in the presence of relatively large amounts of noise and/or signals. It becomes possible, therefore, to operate one or more systems such as FIG. 3 in the same band even where different bands of random signals overlap, or where many standard periodic narrow band communications systems may already be operating. It will be appreciated, therefore, that a given portion of the spectrum may be used at least as efficiently when employing wide band random energy as the carriers as when conventional narrow channel periodic systems are employed. In fact, it is expected that because of the ability of systems such as FIG. 3 to operate even in the presence of relatively large amounts of noise, significantly greater use may be made of a given spectrum than is possible with conventional periodic carrier systems.

It will be appreciated that the system of FIG. 3 can be modified so that frequency modulation of the random signal is employed instead of amplitude modulation as is done in FIG. 2 which is an F-M version of the basic system of FIG. 1. That is, the local oscillator 114, the F-M modulator 116, the mixer 118 and the bandpass amplifier 120 of FIG. 2 may be substituted for the amplitude modulator 18 and the bandpass amplifier 20 to convert the system of FIG. 3 into one in which the message random signal is frequency modulated. The receiver 250 of FIG. 3 is then also modified as in the receiver 150 of FIG. 2 with an F-M detector being employed in place of the A-M detector 42 and the center frequencies and bandwidths of the bandpass amplifier 254 and 244 modified accordingly.

Figure 4:
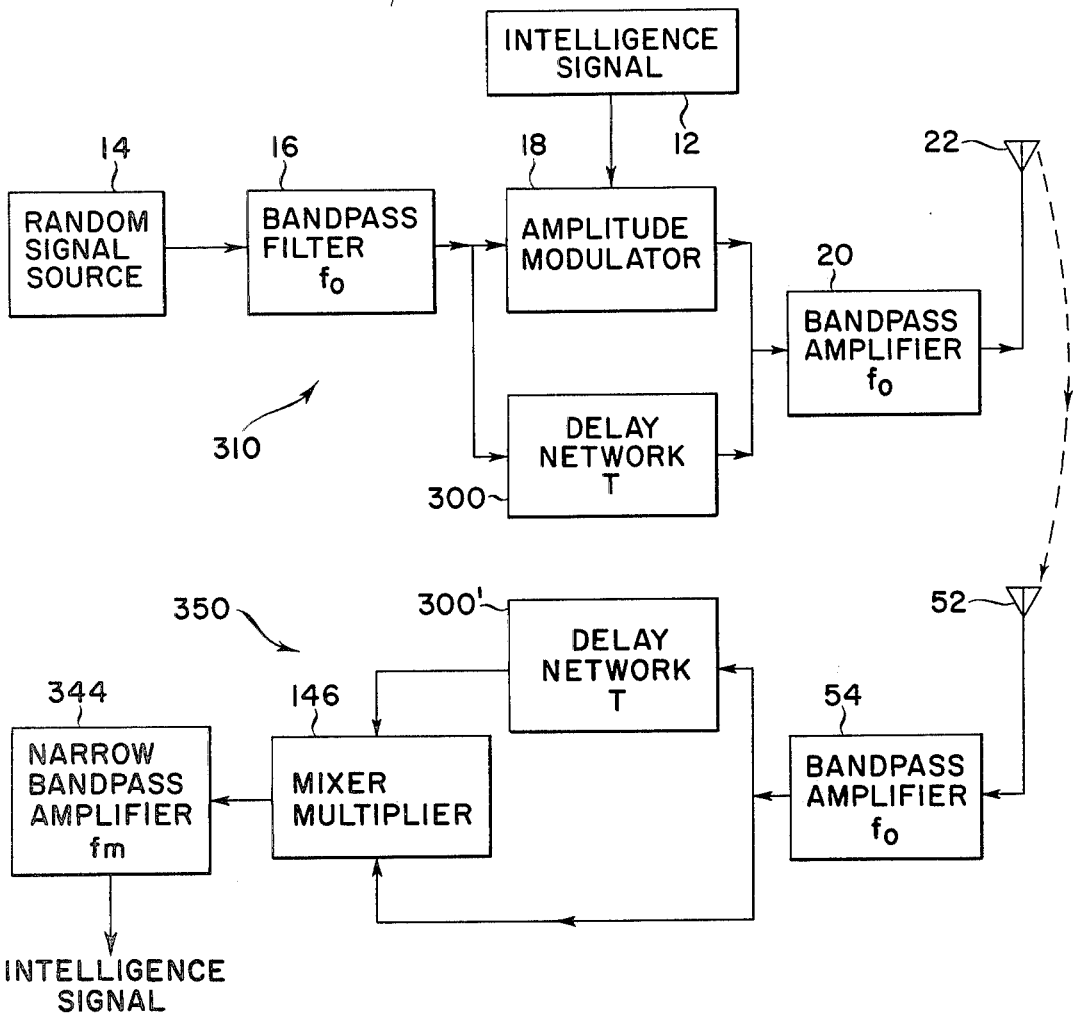
FIG. 4 is a block diagram of another modified embodiment of the transmitting and receiving system of FIG. 3.

FIG. 4 is a simplified version of the system of FIG. 3 which may be employed where signal-to-noise ratio is not a problem. In the system of FIG. 4 the transmitter 310 is modified so that instead of causing separation of the message and reference random signals by means of heterodyning one to a higher frequency, separation or uncorrelation is obtained by introducing a delay into one of the signals in a manner similar to that indicated in connection with FIGS. 3A and 3B. If this is done, the mixer 118 and the local oscillator 214 in the transmitter 210 of FIG. 3 may be eliminated and a delay network 300 which provides a sufficient delay T so that the message and reference random signals will be substantially uncorrelated may be employed instead. In the transmitter 310 of FIG. 4 the reference random signal is then the output from the bandpass filter 16 delayed by T, which may be fed to the bandpass amplifier 20 along with the message random signal from the amplitude modulator 18.

The resultant signal transmitted from the antenna 22 is then a random signal centered at $f_0$ having a bandwidth equal to the band provided by the bandpass filter 16 with the addition of modulation components introduced by amplitude modulation. Such a transmitted signal is entirely unintelligible to a listener who is not aware of the amount of delay provided by the delay network 300, as was pointed out in connection with FIGS. 3A and 3B.

In the receiver 350 of the system of FIG. 4, the single bandpass amplifier 54 now takes the place of the bandpass amplifiers 54 and 254 of FIG. 3. The output from the bandpass amplifier 54 is fed to one input of the mixer multiplier 146 and to the other input of the mixer multiplier 146 through a delay network 300' which provides a delay substantially equal to the delay T provided by the delay network 300 in the transmitter 310. In the mixer multiplier 146 correlation will then be obtained only between the message and reference random signals which have been returned to the same time basis by the introduction of the delay network 300'. The output of the multiplier mixer 146 will then be the intelligence signal 12 itself, which can be amplified by a narrow bandpass amplifier 344 having a bandpass only sufficient to pass the bandwidth thereof.

From the above description of the system of FIG. 4, it will be seen that a significant simplification is achieved over that of the system of FIG. 3. The system of FIG. 4, however, has the disadvantage that because the uncorrelated message and reference random signals are also present at the input to the mixer multiplier 146 as well as the correlated signals, a somewhat greater signal-to-noise ratio is needed for satisfactory operation.

As was the case with the system of FIG. 3, the system of FIG. 4 can also be modified to operate with frequency modulation instead of amplitude modulation. However, for such a modification the output from the mixer multiplier 146 would have to be passed through a conventional type of frequency modulation detection circuit in order to obtain the resultant intelligence signal. All the normal advantages of F-M would then be achieved and this may well warrant the extra circuitry provided, including the necessity for F-M detection in certain cases.

It will be noted in connection with the system of FIG. 4 that no periodic generators are required at all in the system, and since random energy may be employed as the carrier the entire system may be completely free of any signal generation means.

It is to be understood in connection with the systems of FIGS. 1–4 described herein that the electronic circuitry and devices designated in block form in these figures are all of a type which can readily be provided by those skilled in the art. Since the present invention resides chiefly in the combination of these electronic devices and circuitry and not in the design of any particular one thereof, details of these devices and circuitry will not be given. However, based upon the description and operation of the various systems provided herein, those skilled in the art will have no difficulty in practicing the invention.

It is also to be understood that various modifications in construction and arrangement may be made in the systems described and shown in accordance with the invention. For example, those skilled in the art will appreciate that although the systems described herein are particularly advantageous for use with a random energy carrier, they may also be advantageously used with various types of semi-random or periodic carrier systems. Also, other types of modulation of the random carrier or any other carrier which may be used are possible, besides the amplitude and frequency modulation illustrated in the drawing. The above examples are not exhaustive and the invention is to be considered as including all possible modifications and variations coming within the scope of the invention as defined in the appended claims.

We claim as our invention:

1. An intelligence communication system comprising a transmitter and a receiver; said transmitter comprising means for obtaining a relatively wide band random energy carrier signal, means responsive to said energy obtaining means for passing only a restricted frequency band of the energy, means for modulating the restricted band random carrier signal with an intelligence signal thereby forming a message signal, local oscillator, means for mixing the output of said band passing means with the output of said oscillator thereby forming a reference signal, and means for radiating both the message and reference random signals to the receiver from one antenna; said receiver comprising an antenna for picking up both the message and reference random signals simultaneously, first frequency-sensitive means adapted to pass the portion of the received signal corresponding to the message random signal and reject that portion corresponding to the reference random signal, second frequency-sensitive means adapted to pass the portion of the received signal corresponding to the reference random signal and reject that portion corresponding to the message random signal, mixer means for multiplying together the output signals from said first and second means, and demodulation means for deriving the intelligence signal from the output of said mixer means.

2. The invention in accordance with claim 1 wherein means for distorting one of said message and reference random signals is provided in said transmitter and means for removing the distortion is provided in said receiver.

3. An intelligence communication system comprising a transmitter and a receiver; said transmitter comprising means for obtaining a relatively wide band random energy carrier signal thereby forming a message signal, means for modulating said carrier signal with an intelligence signal, means responsive to said carrier signal obtaining means for deriving a reference signal which is delayed in time with respect to said message signal, and means for radiating both the message and reference random signals to said receiver from one antenna; said receiver comprising an antenna for picking up both the message and reference random signals, means for delaying the received message and reference random signals by said predetermined amount, mixer means for multiplying the delayed and undelayed message and reference random signals together, and demodulation means for deriving the intelligence signal from the output of said mixer means.

4. An intelligence communication system comprising a transmitter and a receiver; said transmitter comprising means for obtaining a relatively wide band random energy carrier signal, means for modulating the said random carrier signal with an intelligence signal, thereby forming a message signal, means responsive to said wide band energy obtaining means for deriving a reference signal which is separated from the message signal by frequency shifting and frequency distorting one signal with respect to the other, and an antenna for radiating to the receiver both the message and reference random signals; said receiver comprising an antenna for picking up both the message and reference random signals, means for operating on at least one of said message and reference random signals to obtain message and reference random signals which are recombined, and mixer means for multiplying the recombined message and reference random signals together to obtain a resultant signal from which the intelligence signal can be derived.

5. An intelligence communication system comprising a transmitter and a receiver; said transmitter comprising means for obtaining a relatively wide band random energy carrier signal, means for modulating said random carrier signal with an intelligence signal thereby forming a message signal, means responsive to said wide band energy obtaining means for deriving a reference signal which differs in frequency with said message signal by a definite fixed amount and means for radiating to the receiver both the message and reference random signals; said receiver comprising an antenna for picking up both the message and reference random signal simultaneously, means for operating on at least one of said message and reference random signals to obtain message and reference random signals which are recombined and mixer means for multiplying the recombined message and reference random signals to obtain a resultant signal from which the intelligence signal can be derived.

* * * * *